US009750292B1

(12) United States Patent
Goldman et al.

(10) Patent No.: US 9,750,292 B1
(45) Date of Patent: Sep. 5, 2017

(54) SHIRT GARTER

(71) Applicant: Spanx, Inc., Atlanta, GA (US)

(72) Inventors: Laurie A. Goldman, Atlanta, GA (US); Tosha L. Hays, Atlanta, GA (US); Mary Catherine Moody, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 310 days.

(21) Appl. No.: 14/534,108

(22) Filed: Nov. 5, 2014

Related U.S. Application Data

(60) Provisional application No. 61/934,838, filed on Feb. 2, 2014.

(51) Int. Cl.
*A41F 19/00* (2006.01)
*A41F 17/00* (2006.01)
*A41F 3/00* (2006.01)

(52) U.S. Cl.
CPC ..... *A41F 17/00* (2013.01); *A41F 3/00* (2013.01)

(58) Field of Classification Search
CPC .. A41F 3/02; A41F 3/00; A41F 15/007; A41F 11/02
USPC ..... 2/340, 326, 336, 327, 335
See application file for complete search history.

(56) References Cited

U.S. PATENT DOCUMENTS 287,020 A * 10/1883 Greely ..... A41F 3/00 2/326
949,827 A * 2/1910 Kurtz ..... A41D 1/10 2/233
1,281,523 A * 10/1918 Scudder et al. ..... D06F 55/00 2/335
1,320,641 A * 11/1919 McCain ..... A41F 3/00 2/334
1,653,288 A * 12/1927 Johnson ..... A41F 17/00 2/326
1,967,925 A * 7/1934 Cumbler ..... A41F 3/02 2/333
4,853,979 A * 8/1989 Ryder ..... A41F 17/00 2/326
4,937,886 A * 7/1990 Ellis ..... A41F 17/00 2/323
5,172,429 A * 12/1992 Lucier ..... A41F 3/02 2/300
5,177,813 A * 1/1993 Bosack ..... A41F 3/02 2/323
6,088,839 A * 7/2000 Utamaru ..... A41F 3/02 2/326
2004/0187194 A1* 9/2004 Gilliam ..... A41F 3/02 2/340
2013/0091621 A1* 4/2013 Lu ..... A41F 3/00 2/326
2016/0295943 A1* 10/2016 Gilroy ..... A41F 3/00

OTHER PUBLICATIONS

CTM Shirt Stays and Sock Garters, available at http://www.beltoutlet.com/shsogakeshdo.html (accessed Jan. 7, 2014).

* cited by examiner

*Primary Examiner* — Tejash Patel
(74) *Attorney, Agent, or Firm* — Meunier Carlin & Curfman LLC

(57) ABSTRACT

This disclosure relates generally to a shirt garter (also known as a shirt stay). More specifically, this disclosure relates a shirt garter that extends around the crotch region of the wearer and is designed for use with a camisole or other shirt-type garment.

18 Claims, 7 Drawing Sheets

SHIRT GARTER

CROSS-REFERENCE TO RELATED APPLICATIONS

This application claims the benefit of priority to U.S. Provisional Patent Application No. 61/934,838 filed Feb. 2, 2014, the disclosure of which is incorporated herein by reference in its entirety.

TECHNICAL FIELD

This disclosure relates generally to a shirt garter (also known as a shirt stay). More specifically, this disclosure relates a shirt garter that extends around the crotch region of the wearer and is designed for use with a camisole or other shirt-type garment.

BACKGROUND

Shirt garters (stays) are used to hold the wearer's shirt in place (i.e., tucked in) and are generally made of an elastic strap that connects the bottom of the wearer's shirt to the socks or feet. Because these shirt stays extend along the wearer's leg, they can only be worn with full length pants and/or socks and cannot be worn with skirts, dresses, crop pants, shorts, etc. The bulk and design of these shirt stays makes them difficult to remove/adjust when needed by the wearer. Also, because they are usually constructed from an elongated elastic band, they are frequently visible through/under lightweight fabrics. Accordingly, a need in the art exists for a shirt garter that does not require coupling to the wearer's socks and/or feet, is easily adjusted/removed, and is not visible under lightweight fabrics.

SUMMARY

Presented are systems and methods for coupling a garter to shirt-type garment. An aspect of the present disclosure is directed to a garter. The garter may include at least three elongate members, including a first, second and third elongate member. A first end of each of the first and second elongate members may be coupled to a first end of the third elongate member to form a Y-shape. The garter may also include a fastener coupled to a second end of each of the first, second and third elongate members. The fasteners may be configured to be coupled to a garment.

Another aspect of the present disclosure is directed to a garment and garter for keeping the garment in place when worn by a user. The garter may include at least three elongate members, including a first, second and third elongate member. A first end of each of the first and second elongate members may be coupled to a first end of the third elongate member to form a Y-shape. The garter may also include a fastener coupled to a second end of each of the first, second and third elongate members. The fasteners may be coupled to the garment such that the elongate members are configured to extend along a crotch section of the wearer. Additionally, the fasteners may be coupled to the garment such that the fastener of the first and second elongate members are coupled to a front of the garment and the fastener of the third elongate member is coupled to a back of the garment.

A further aspect of the present disclosure is directed to a method of securing a garment in place on a user. The method may include providing a garter having at least three elongate members including a first, second and third elongate member, where a first end of each of the first and second elongate members may be coupled to a first end of the third elongate member to form a Y-shape. The garter may also include a fastener coupled to a second end of each of the first, second and third elongate members. The method may further include coupling the first and second elongate members to a front of the garment and coupling the fastener of the third elongate member to a back of the garment. The fasteners may be coupled to the garment such that the elongate members extend along a crotch section of the user.

The details of one or more embodiments of the disclosure are set forth in the accompanying drawings and description below. Other features, objects, and advantages of the disclosure will be apparent from the description and drawings, and from the claims.

DESCRIPTION OF DRAWINGS

The device is explained in even greater detail in the following drawings. The drawings are merely examples to illustrate the structure of preferred devices and certain features that may be used singularly or in combination with other features. The disclosure should not be limited to the examples shown.

Like reference symbols in the various drawings indicate like elements.

DETAILED DESCRIPTION

Figure 1:
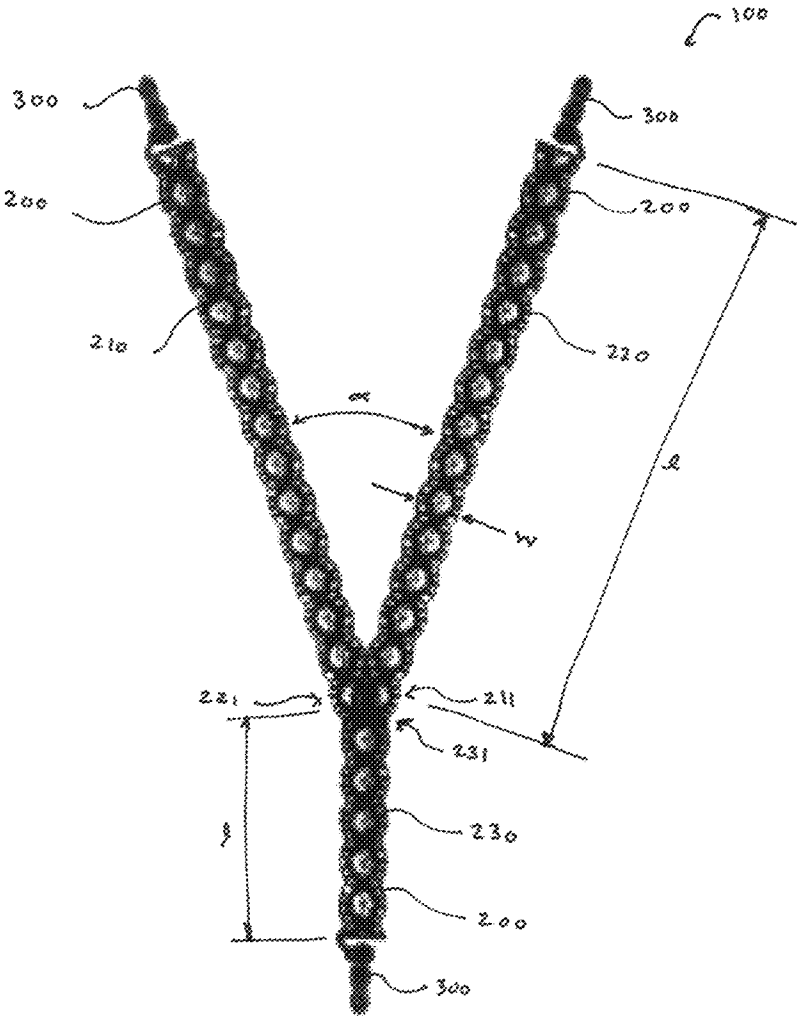
FIG. 1 is a front view of an example garter.

Certain terminology is used in the following description for convenience only and is not limiting. The words "right," "left," "lower," and "upper" designate direction in the drawings to which reference is made. The words "inner" and "outer" refer to directions toward and away from, respectively, the geometric center of the described feature or device. The words "distal" and "proximal" refer to directions taken in context of the item described and, with regard to the instruments herein described, are based on the perspective of the surgeon using such instruments. The terminology includes the above-listed words, derivatives thereof, and words of similar import.

In addition, various components may be described herein as extending horizontally along a longitudinal direction "L" and lateral direction "A," and vertically along a transverse direction "T." Unless otherwise specified herein, the terms "lateral," "longitudinal," and "transverse" are used to describe the orthogonal directional components of various items. It should be appreciated that while the longitudinal and lateral directions are illustrated as extending along a horizontal plane, and that the transverse direction is illustrated as extending along a vertical plane, the planes that encompass the various directions may differ during use.

Accordingly, the directional terms "vertical" and "horizontal" are used to describe the components merely for the purposes of clarity and illustration and are not meant to be limiting.

Certain examples of the disclosure will now be described with reference to the drawings. In general, such embodiments relate to a garter 100 configured to be coupled to a garment 500. The garter 100 can include elongated members 200 coupled to fasteners 300 for attaching the garter 100 to the garment 500. The garment 500 can include, for example, shirts, camisoles, undergarments, undershirts, compression garments, shapewear, tanks, and active wear, and/or any other shirt-type garment worn on the upper body of the wearer.

FIG. 1 provides a front view of an example garter 100. The garter 100 can include a plurality of elongated members 200. It is also contemplated that the garter 100 can include a single elongate member 200 and/or any number of elongate members 200. For example, the garter 100 can include at least three elongate members 200 including a first elongate member 210, a second elongate member 220, and a third elongate member 230. The elongate members 200 can be joined together and/or integrally formed. For example, the elongate members 200 can be joined at a seam, a clasp, a clip (e.g., loop-and-button, toothed, etc.), a snap, a hook and eye, a zipper, a buckle, a toggle, a button, a lace, an adhesive (e.g., VELCRO, fusible interfacing), or any other fastener known in the art. As illustrated in FIG. 1, the first, second, and third elongate members 210, 220, 230 can be coupled at a seam to form a Y-shape. For example, a first end 211 of the first elongate member 210 and a first end 221 of the second elongate member 220 can be coupled to a first end 231 of the third elongate member 230.

The elongate member 200 can have a length (l) measured between the first end and the second end of the elongate member 200. It is contemplated that each of the first, second and third elongate members 210, 220, 230 can have the same, different, and/or varying length. For example, as provided in FIG. 1, the first and second elongate members 210, 220 can have an equal length. For example, the first and second elongate members 210, 220 can have a length (l) between 5 inches and 10 inches. In another example, the first and second elongate members 210, 220 can have a length (l) between 7 inches and 8 inches. In yet another example, the first and second elongate members 210, 220 can have a length (l) between 7½ inches and 8 inches. In a further example, the third elongate member 230 can have a length (l) between 3 inches and 6 inches. In yet another example, the third elongate member 230 can have a length (l) between 4 inches and 5 inches. In another example, the third elongate member 230 can have a length (l) between 4 inches and 4½ inches. In another example garter 100 (not shown), the length of the first, second and/or third elongate members 210, 220, 230 is adjustable. For example, the elongate member 200 can include a buckle and a length of material that can be manipulated by the wearer to adjust (lengthen and/or shorten) the length of the elongate member 200. The elongate members 200 can have a width (w) measured between opposing left and right sides of the elongate members 200. It is contemplated that each of the first, second and third elongate members 210, 220, 230 can have the same, different, and/or varying width (w). For example, as provided in FIG. 1, the first, second and third elongate members 210, 220, 230 can have an equal width (w). For example the first, second and third elongate members 210, 220, 230 can have a width (w) between ¼ inch and 1½ inches. In another example, the first, second and third elongate members 210, 220, 230 can have a width (w) between ½ inch and 1 inch. In yet another example, the first, second and third elongate members 210, 220, 230 can have a width (w) between ½ inch and ¾ inch. As illustrated in FIG. 1, the first, second, and third elongate members 210, 220, 230 can be coupled to form a Y-shape. The spacing between the first and second elongate members 210, 220 can define an angle (α) measured between the centerline of the first elongate member 210 and the centerline of the second elongate member 220. In an example garter 100, the angle (α) can be between 10° and 60°. In another example, the angle (α) can be between 20° and 45°. In a further example, the angle (α) can be between 25° and 45°.

The elongate members 200 can be constructed from a woven or knit fabric. For example, the elongate member can be constructed from a fabric comprising spandex, spandex filament yarn, stretch vinyl, polyester, silk, cotton, rayon, nylon, and/or any other fabric known in the art, including mixtures thereof. For example, the elongate members 200 can be constructed from a fabric comprising an elastomer. An elastomer is a viscoelastic polymer that often has a high failure strain and low elastic modulus, when compared with other materials. In an example garter 100, the elongate members 200 can be constructed from a woven and/or knit elastomer-containing fabric. For example, the fabric can comprise 1% to 25% (e.g., 15% to 20%), by weight, of elastomer and 75% to 99%, by weight, of non-elastomer. The elastomer-containing fabric can comprise, for instance 1% to 25% spandex (e.g., 10% to 20%, 15% to 20%). In one example, the elastomer-containing fabric is a knitted lace. In another example, the elastomer-containing fabric is knit fabric comprising 16% spandex and 84% nylon. The composition of the fabric can be selected to help provide the desired stretch and strength when using the garter 100 to secure the position of the garment 500 with respect to the wearer's body.

The elongate members 200 can include a fastener 300 for coupling the elongate member 200 to a garment 500. The fastener 300 can include a clasp, a clip (e.g., loop-and-button, toothed, etc.), a snap, a hook and eye, a zipper, a buckle a toggle, a button, a lace, an adhesive (e.g., VELCRO), or any other removable fastener known in the art. As illustrated in FIG. 1, the example fastener 300 can include a loop-and-button style garter clip.

Each of the elongate members 200 can include a fastener 300 configured to couple the garter 100 to a garment 500. For example, the first elongate member 210 can have a fastener 300 coupled to its second end 212, the second elongate member 220 can have a fastener 300 coupled to its second end 222, and the third elongate member 230 can have a fastener 300 coupled to its second end 232. The fastener 300 can be removable and/or permanently coupled to the elongate member 200.

Figure 2B:
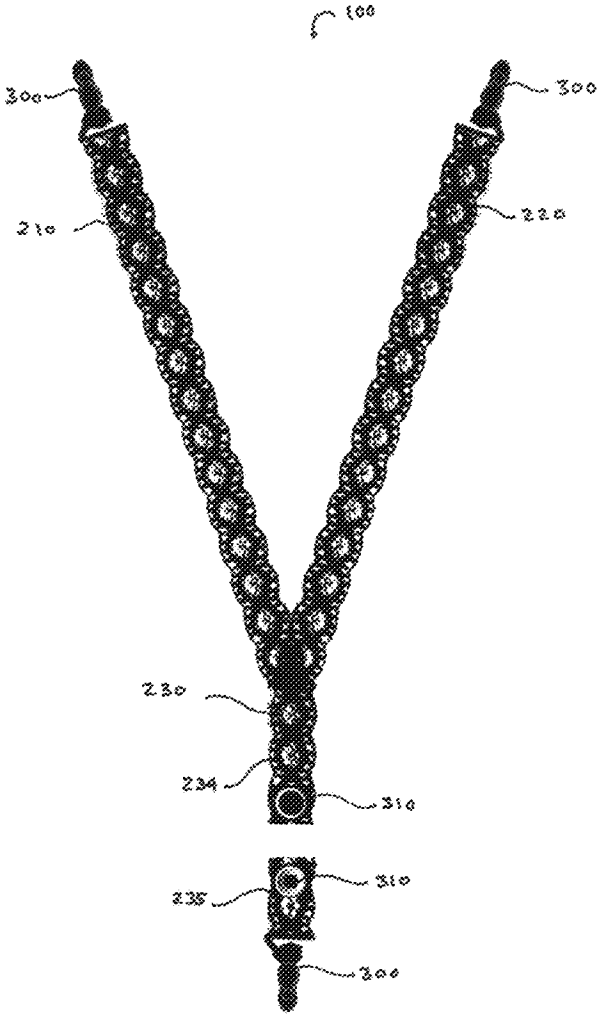
FIG. 2B is a front view of an example garter including a releasable fastener.
Figure 2A:
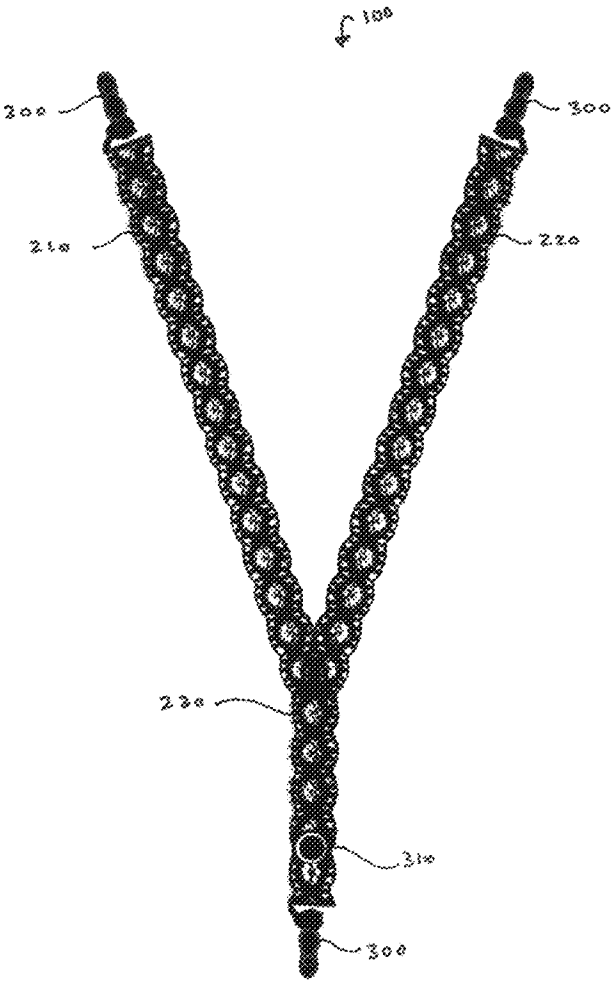
FIG. 2A is a front view of an example garter including a releasable fastener.

The fastener 300 can have length (l) measured from the proximal and distal ends of the fastener 300. For example, the fastener 300 can have a length (l) between ¼ inch and 2 inches. In another example, the fastener 300 can have a length (l) between 1 inch and 2 inches. In a further example, the fastener 300 can have a length (l) between 1½ inches and 2 inches. Accordingly, the garter 100 can have an overall length (L) measured between the distal end of the fasteners 300 coupled to the first and second elongate members 210, 220 and the fastener 300 coupled to the third elongate member 230 is between 10 inches and 15 inches. In another example, the overall length (L) of the garter 100 is between 12 inches and 14 inches. Likewise, the garter 100 can have an overall width (W) measured between the fastener 300 coupled to the first elongate member 210 and the fastener 300 coupled to the second elongate member 220 between 5 inches and 10 inches. In another example, garter 100 can have an overall width (W) between 6 inches and 8 inches In another example, the garter 100 can include a releasable fastener 310. For example, as illustrated in FIGS. 2A and 2B, the garter 100 can include a releasable fastener 310 located on the third elongated member 230. Though illustrated on the third elongated member 230, it is contemplated that any of the first, second and/or third elongated members 210, 220, 230 can include a releasable fastener 310. Using the releasable fastener 310, a wearer of the garter 100 can easily and quickly separate the garter 100. For example, when needing to adjust the position of the garment 500, the wearer may not wish to uncouple the fasteners 300 from the garment 500. The releasable fastener 310 permits the wearer to separate the garter 100 into two distinct pieces such that repositioning and/or removal of the garment 500 is possible without separating the garter 100 fasteners 300 from the garment 500. Likewise, the releasable fastener 310 permits the wearer to separate the garter 100 into two distinct pieces such that repositioning of the garter 100 and/or access to the area between and the wearer's body is possible without separating the garter 100/fasteners 300 from the garment 500. For example, as provided in FIGS. 2A and 2B, the releasable fastener 310 can be located intermediate the first and second end 231, 232 of the third elongate member 230. FIG. 2B illustrates the releasable fastener 310 disconnected such that the third elongated member separable into at least two portions (e.g., a first and second portion 234, 235). FIG. 2A illustrates a releasable fastener 310 connected such that the first and second portions 234, 235 are coupled and the third elongated member 230 forms a single member. The releasable fastener 310 can include any fastener-type known in the art for coupling and uncoupling material. Example releasable fasteners 310 can include a clasp, a clip (e.g., loop-and-button, toothed, etc.), a snap, a hook and eye, a zipper, a buckle, a toggle, a button, a lace, an releasable adhesive (e.g., VELCRO), or any other releasable fastener 310 known in the art. As illustrated in FIGS. 2A and 2B, the releasable fastener 310 can include a snap for connecting the first and second portions 234, 235 of the third elongated member 230. A stabilizer and/or interfacing can be used proximate the releasable fastener 310 to provide permanent and/or temporary support and strength to the material of the elongate member near the releasable fastener 310. Example woven and non-woven stabilizers can include cut-away, tear-away, heat-away, water-soluble, filmoplast, and/or combinations thereof.

Figure 3:
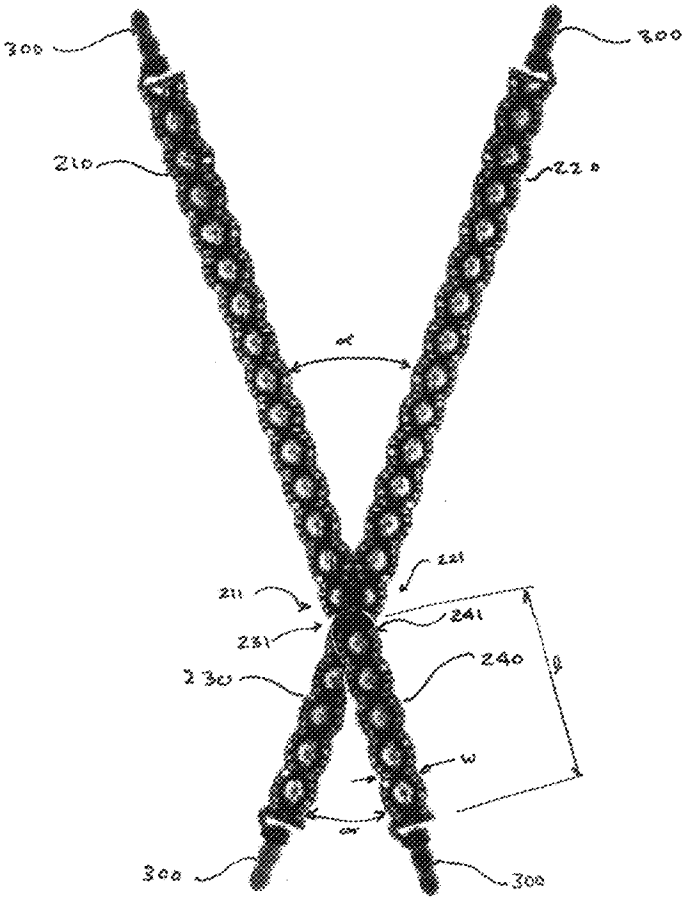
FIG. 3 is a front view of an example garter.

In another example, the garter 100 can include a fourth elongate member 240. For example, as illustrated in FIG. 3, the garter 100 can include at least four elongate members 200 including a first elongate member 210, a second elongate member 220, a third elongate member 230 and a fourth elongate member 240. As outlined above, the elongate members 200 can be joined together and/or integrally formed. As illustrated in FIG. 3, the first, second, third and fourth elongate members 210, 220, 230, 240 can be coupled at a seam to form an X-shape. For example, a first end 211 of the first elongate member 210 and a first end 221 of the second elongate member 220 can be coupled to a first end 231 of the third elongate member 230 and a first end 241 of the fourth elongate member 240.

The fourth elongate member 240 can have a length (l) measured between the first end 241 and the second end 242 of the fourth elongate member 240. It is contemplated that each of the first, second, third and fourth elongate members 210, 220, 230, 240 can have the same, different, and/or varying length. For example, as provided in FIG. 4, the third and fourth elongate members 230, 240 can have an equal length. For example, the third and fourth elongate members 230, 240 can have a length (l) between 3 inches and 6 inches. In another example, the third and fourth elongate members 230, 240 can have a length (l) between 4 inches and 5 inches. In a further example, the third and fourth elongate members 230, 240 can have a length (l) between 4 inches and 4½ inches. outlined above, it is also contemplated that the length of the first, second, third and/or fourth elongate members 210, 220, 230, 240 are adjustable. The fourth elongate member 240 can have a width (w) measured between opposing left and right sides of the elongate member. It is contemplated that each of the first, second, third and fourth elongate members 210, 220, 230, 240 can have the same, different, and/or varying width (w). For example, as provided in FIG. 4, the first, second, third and fourth elongate members 210, 220, 230, 240 can have an equal width (w). For example the first, second, third and fourth elongate members 210, 220, 230, 240 can have a width (w) between ¼ inch and 1½ inches. In another example, the first, second, third and fourth elongate members 210, 220, 230, 240 can have a width (w) between ½ inch and 1 inch. In yet another example, the first, second, third and fourth elongate members 210, 220, 230, 240 can have a width (w) between ½ inch and ¾ inch. As illustrated in FIG. 3, the first, second, third and fourth elongate members 210, 220, 230, 240 can be coupled to form an X-shape. The spacing between the first and second elongate members 210, 220 and the third and fourth elongate members 230, 240 can define an angle ($\alpha$) measured between the centerline of each of the respective elongate members 200. It is contemplated the angle ($\alpha$) between the first and second elongate members 210, 220 can be the same and/or different from the angle ($\alpha$) between the third and fourth elongate members 230, 240. As illustrated in FIG. 3, the angle ($\alpha$) between the first and second elongate members 210, 220 is equal to the angle ($\alpha$) between the third and fourth elongate members 230, 240. In an example garter 100, the angle ($\alpha$) between the third and fourth elongate members 230, 240 can be between 10° and 60°. In another example, the angle ($\alpha$) between the third and fourth elongate members 230, 240 can be between 20° and 45°. In a further example, the angle ($\alpha$) between the third and fourth elongate members 230, 240 can be between 25° and 45°. The fourth elongate member 240 can also include a fastener 300 configured to couple the fourth elongate member 240 to a portion of a garment 500. For example, the fourth elongate member 240 can include a fastener 300 removably and/or permanently coupled to its second end 242.

Figure 4:
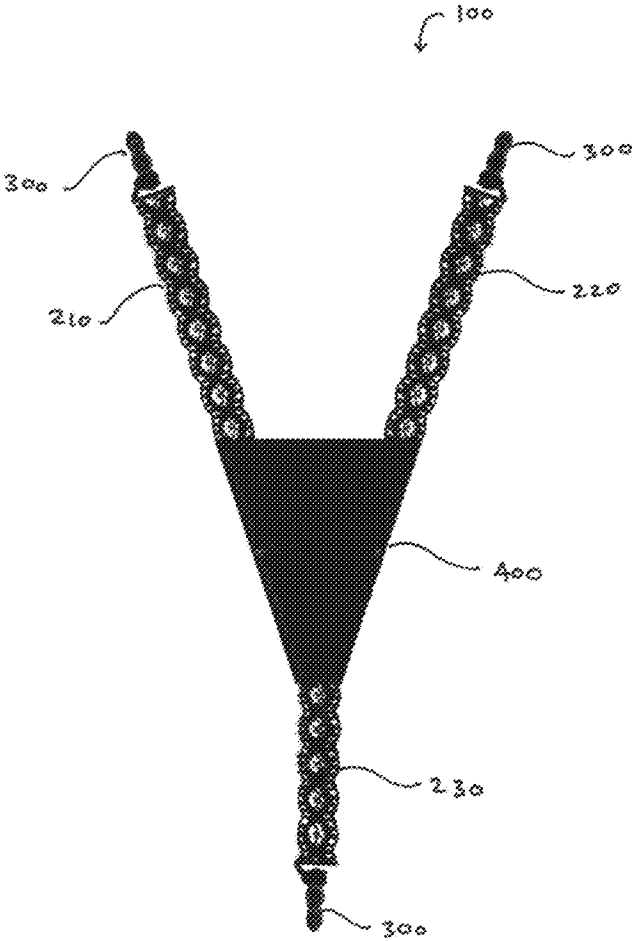
FIG. 4 is a front view of an example garter including a panel.

In another example, the garter 100 can include a panel 400 located intermediate the proximal (front) and distal (back) portions of the garter 100, as illustrated in FIG. 4. For example, the garter 100 can include a material panel 400 that can be located proximate the crotch section of the wearer then the garter 100 is worn with a garment 500. The panel 400 can be coupled to each of the elongate members 200. For example, the first end of each of the first, second and third elongate members 210, 220, 230 can be coupled to the panel 400. Likewise, the panel 400 can be coupled along a length of each of the first, second and third elongate members 210, 220, 230. The panel 400 can define a triangle shape, a rhomboid shape, a rectangular shape, square shape or any other regular or irregular shape known in the art. The panel 400 can be constructed from the same and/or different material as the elongate members 200.

Figure 5:
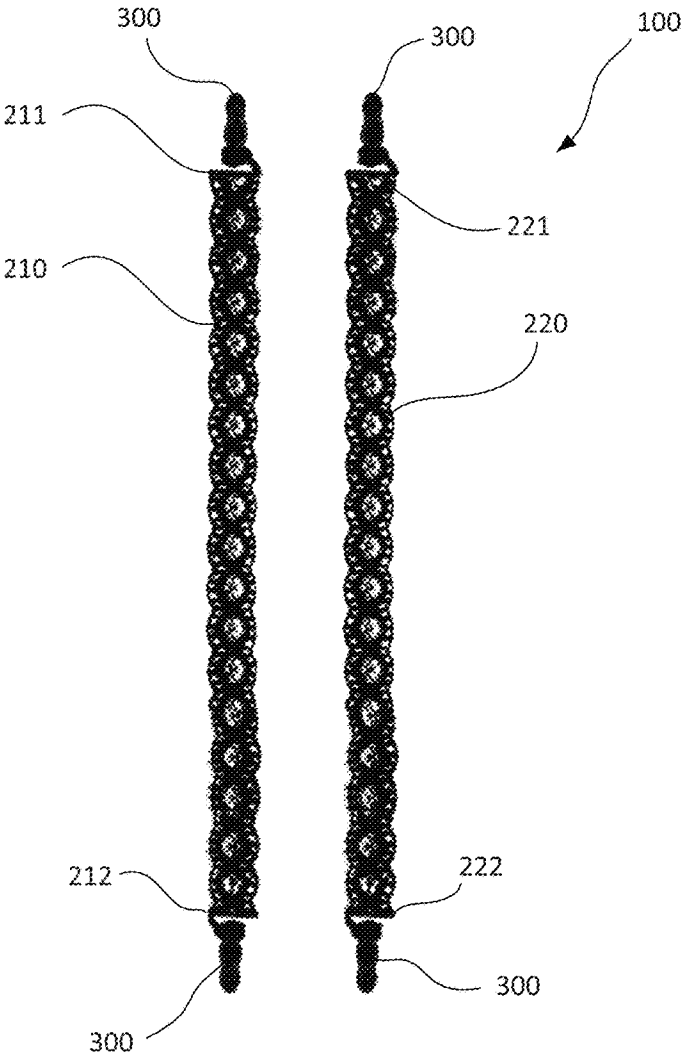
FIG. 5 is a front view of an example garter.

In further example, the garter 100 can include two separate elongate members 200. For example, as illustrated in FIG. 5, the garter 100 can include a first elongate member 210 and a separate, second elongate member 220. The first end 211 of the first elongate member 210 and the first end 221 of the second elongate member 220 can be coupled to fasteners 300 for joining the garter 100 to the front of a garment 500. Likewise, the second end 212 of the first elongate member 210 and the second end 222 of the second elongate member 220 can be coupled to fasteners 300 for joining the garter 100 to the back of a garment 500. It is contemplated that the first elongate member 210 will be used in conjunction with the second elongate member 220. In another example, the first elongate member 210 and/or second elongate member 220 can be used individually. For example, only the first elongate member 210 is coupled to the garment 500.

The first and second elongate members 210, 220 can have a length (l) measured between the first end 211 and a second end 212 of the first elongate member 210, and between the first end 221 and second end 222 of the second elongate member 220. It is contemplated that the first elongate member 210 and the second elongate member 220 can have the same, different, and/or varying length. For example, as provided in FIG. 5, the first and second elongate members 210, 220 can have an equal length. In one example the first and second elongate members 210, 220 can have a length (l) between 5 inches and 10 inches. In another example, the first and second elongate members 210, 220 can have a length (l) between 6 inches and 8 inches. In a further example, the first and second elongate members 210, 220 can have a length (l) between 6½ inches and 7½ inches. In yet another example, the first and second elongate members 210, 220 can have a length (l) of 7 inches.

As outlined above, it is also contemplated that the length (l) of the first and second elongate members 210, 220 are adjustable. The first and/or second elongate members 210, 220 can have a width (w) measured between opposing left and right sides of the elongate member. It is contemplated that each of the first and second elongate members 210, 220 can have the same, different, and/or varying width (w). For example, as provided in FIG. 5, the first and second elongate members 210, 220 can have an equal width (w). For example the first and second elongate members 210, 220 can have a width (w) between ¼ inch and 1½ inches. In another example, the first and second elongate members 210, 220 can have a width (w) between ½ inch and 1 inch. In yet another example, the first and second elongate members 210, 220 can have a width (w) between ½ inch and ¾ inch.

As outlined above, the fasteners 300 can be used to couple the garter 100 to a garment 500. FIGS. 6A-6D illustrate a garter 100 coupled to a garment 500 as worn by as user. As provided in FIGS. 6A-6D, the garter 100 can be coupled to the garment 500 such that the garter 100 extends around the crotch region of the wearer. For example, the fasteners 300 of the first and second elongate members 210, 220 can be coupled to the front of the garment 500. Likewise, the fastener 300 of the third elongate member 230 can be coupled to the back of the garment 500. Where the garter 100 includes a fourth elongate member 240, as illustrated in FIG. 3, the fourth elongate member 240 can also be coupled to the back of the garment 500.

Figure 6A:
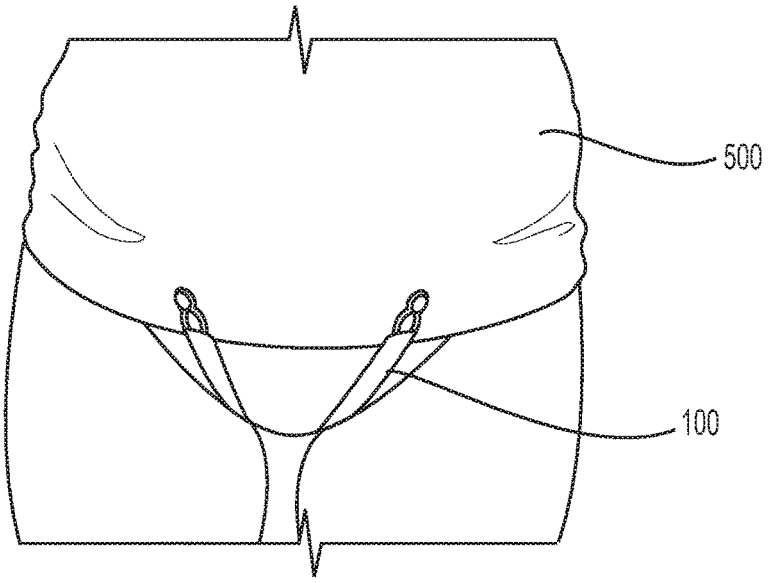
FIG. 6A is a front view of an example garter and garment.
Figure 6B:
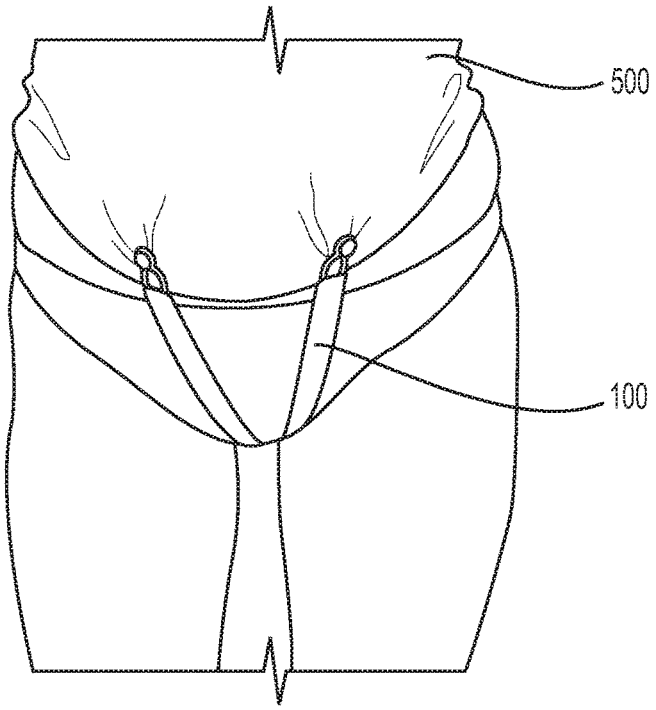
FIG. 6B is a front view of an example garter and garment.
Figure 6C:
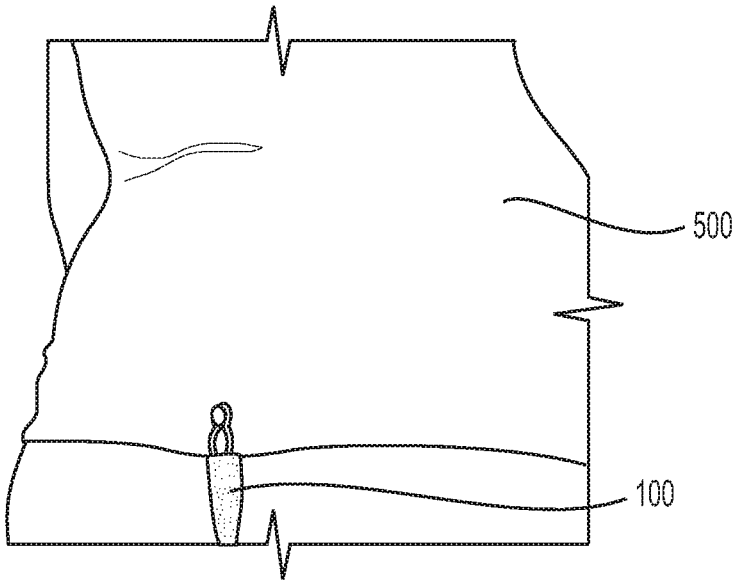
FIG. 6C is a back perspective view of an example garter and garment.
Figure 6D:
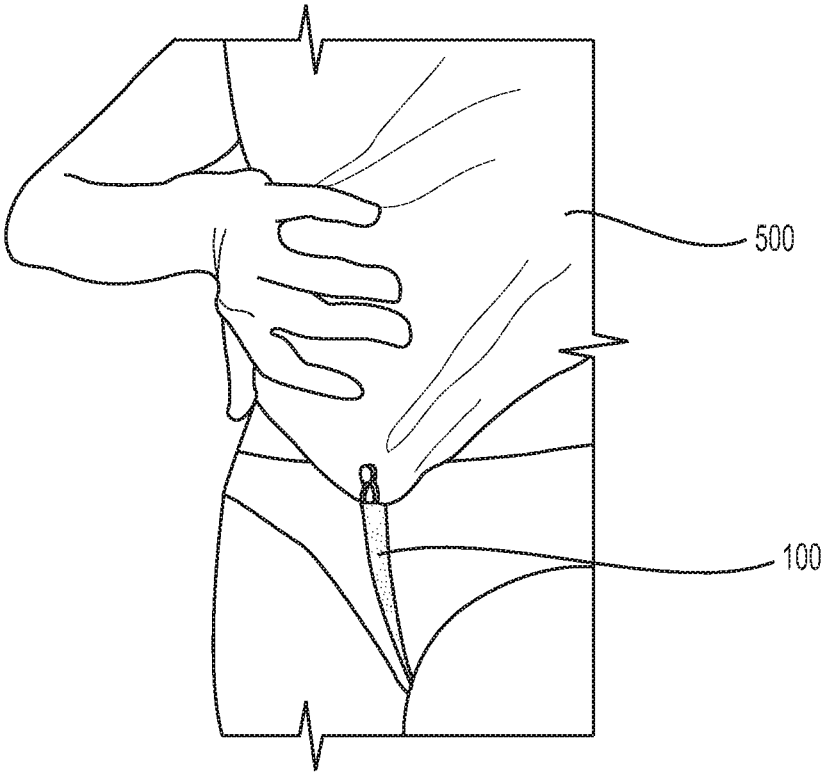
FIG. 6D is a back perspective view of an example garter and garment.

The garter 100 can be used to maintain the position of the garment 500. For example, FIGS. 6A and 6B provide a front view of an example garter 100 when worn with a garment 500. As illustrated in FIG. 6B, as the position of the garment 500 changes (e.g., rides up the wearer's torso), the garter 100 secures at least a portion of the front hem at a desired position (e.g., proximate the wearer's waist). FIGS. 6C and 6D provide a back view of an example garter 100 when worn with a garment 500. As illustrated in FIG. 6D, as the position of the garment 500 changes (e.g., rides up the wearer's torso), the garter 100 secures at least a portion of the rear hem at a desired position.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A garter comprising:

at least three elongate members including a first, second and third elongate member, a first end of each of the first and second elongate members coupled to a first end of the third elongate member to form a Y-shape;

a fastener coupled to a second end of each of the first, second and third elongate members, the fasteners configured to be coupled to a garment; and a panel coupled to each of the first, second and third elongate members, wherein the panel and at least one of the elongate members are constructed of a fabric comprising an elastomer.

2. The garter of claim 1, wherein the at least three elongate members each have a width between ¼ inch and 1½ inches.

3. The garter of claim 1, wherein the first elongate member and the second elongate member of the at least three elongate members are of equal length, wherein the length of the first elongate member and the second elongate member is between 5 inches and 10 inches.

4. The garter of claim 1, wherein an angle between a center line of the first elongate member of the at least three elongate members and a center line of the second elongate member of the at least three elongate members is between 10° and 60°.

5. The garter of claim 1, wherein the third elongate member has a length between 3 inches and 6 inches.

6. The garter of claim 1, wherein the elastomer is spandex.

7. The garter of claim 1, wherein the fabric material comprises 1% to 25%, by weight, of elastomer.

8. The garter of claim 1, wherein at least one of the fasteners are removable from the second end of a corresponding one of the first, second and third elongate members.

9. The garter of claim 1, wherein the fastener has a length between 1 inch and 2 inches.

10. The garter of claim 1, wherein the third elongate member includes releasable fastener located intermediate the first and second end of the third elongate member, the releasable fastener releasably coupling a first portion of the third elongate member to a second portion of the third elongate member.

11. The garter of claim 1, further comprising:

a fourth elongate member, a first end of the fourth elongate member coupled to the first end of the third elongate member to form an X-shape, a fastener coupled to a second end of the fourth elongate member, the fastener configured to be coupled to a garment.

12. The garter of claim 1, wherein the panel defines one of a triangle shape or a rhomboid shape.

13. The garter of claim 1, wherein the material panel is located at the crotch section of the user when the garter is worn.

14. A garment and garter for keeping the garment in place when worn by a user comprising:

the garter including:

at least three elongate members including a first, second and third elongate member, a first end of each of the first and second elongate members coupled to a first end of the third elongate member to form a Y-shape;

a fastener coupled to a second end of each of the first, second and third elongate members; and a panel coupled to each of the first, second and third elongate members, wherein the panel and at least one of the elongate members are constructed of a fabric comprising an elastomer;

wherein the fasteners are coupled to the garment such that the elongate members are configured to extend along a crotch section of the user; and wherein the fasteners are coupled to the garment such that the fastener of the first and second elongate members are coupled to a front of the garment and the fastener of the third elongate member coupled to a back of the garment.

15. The garment and garter of claim 14, further comprising:

a fourth elongate member, a first end of the fourth elongate member coupled to the first end of the third elongate member to form an X-shape; and a fastener coupled to a second end of the fourth elongate member, wherein the fastener of the fourth elongate member is coupled to the back of the garment.

16. The garment and garter of claim 14, wherein the garment is a shirt-type garment.

17. A garter comprising:

a first elongate member including a fastener coupled to a first end of the first elongate member and a fastener coupled to a second end of the first elongate member, the fasteners configured to be coupled to a garment;

a second elongate member including a fastener coupled to a first end of the second elongate member and a fastener coupled to a second end of the second elongate member, the fasteners configured to be coupled to a garment;

wherein at least one of the first and second elongate members are constructed from a fabric comprising an elastomer; and wherein the first elongate member and the second elongate member are not attached to each other.

18. The garter of claim 17, wherein the first and second elongate members have a length between 5 inches and 10 inches.

* * * * *